United States Patent [19]

Forbes, Jr.

[11] 4,247,038

[45] Jan. 27, 1981

[54] BAKE-IN-TRAY

[75] Inventor: Hampton E. Forbes, Jr., Wilmington, Del.

[73] Assignee: Westvaco Corporation, New York, N.Y.

[21] Appl. No.: 66,812

[22] Filed: Aug. 15, 1979

[51] Int. Cl.[3] ..... B65D 3/04; B65D 5/24

[52] U.S. Cl. ..... 229/32; 229/23 R

[58] Field of Search ..... 229/32, 1.5 B, 23 R

[56] References Cited

U.S. PATENT DOCUMENTS

| | | | |
|---|---|---|---|
| 1,894,209 | 1/1933 | Wikstrom | 229/32 X |
| 2,242,684 | 5/1941 | Stuart | 229/2.5 |
| 2,407,118 | 9/1946 | Waters | 229/2.5 X |
| 3,300,117 | 1/1967 | Kossmar | 229/32 |
| 3,327,921 | 6/1967 | Baugham | 229/32 X |
| 3,563,448 | 2/1971 | Croley | 229/23 R |
| 3,565,324 | 2/1971 | Odenhagen | 229/32 X |
| 3,733,023 | 5/1973 | Arneson | 229/1.5 B X |
| 3,767,108 | 10/1973 | Arneson | 229/1.5 B X |
| 3,863,832 | 2/1975 | Gordon et al. | 229/32 X |
| 3,877,631 | 4/1975 | Lai et al. | 229/23 BT X |

*Primary Examiner*—Davis T. Moorhead

[57] ABSTRACT

A polygonal shaped, tray-like receptacle which includes an integral bottom wall, side wall and peripheral flange is formed from a single blank of paperboard wherein the side walls and peripheral flange are divided into individual segments. The side wall segments each include a tab element that is foldably attached to a lateral edge thereof and which is secured to the outer surface of the next adjacent side wall when the receptacle is formed. Meanwhile, the peripheral flange segments each include extensions at the ends thereof which become interlocked when the receptacle is being formed, and that are secured alternately to the outer and inner surfaces of the adjacent flange panels.

2 Claims, 2 Drawing Figures

BAKE-IN-TRAY

BACKGROUND OF INVENTION

The present invention relates to the packaging of food products and more particularly to a polygonal shaped tray-like receptacle that is formed from a single blank of paperboard or the like.

Many different types and designs of containers have been developed for packaging food products and the like in order to meet the needs of particular markets. Recently there has been an increased emphasis on the use of paperboard for such packages, and, more particularly, ovenable paperboard.

Ovenable paperboard is paperboard that is treated to withstand the temperatures encountered in a conventional oven, and, of course, for use in microwave ovens. Paperboard is a particularly good material to use for food packages in microwave ovens because the paperboard does not affect the transmission of the microwaves to the packaged food. In addition, paperboard packages can be easily and readily formed and glued on conventional forming equipment already available. Accordingly, for the purposes of the present invention, the tray disclosed is of the type that is formed from a blank of paperboard that is folded and glued into its final configuration.

U.S. Pat. No. 2,242,684 discloses a baking utensil of the type disclosed herein which is formed from any suitable flexible material such as paper, laminated paper or laminated paper and metal foil. The tray shown in the patent is formed from a single blank of material that is die cut, scored and then placed in a mold where pressure is applied causing the scored serrations in the side walls to be folded flat into pleats. The pleats are then locked into closed position with staples or the like applied to the rim of the tray. In general, the baking tray disclosed in U.S. Pat. No. 2,242,684 performs quite well except that, even with the modifications provided therefor in the flange area, the final configuration ends up with three thicknesses of material in the pleated area and either two or three thicknesses of the tray material in the flange where the pleats are formed. Thus, in some cases, a separate element is needed to fasten the flange and keep the tray in its assembled condition. Meanwhile, U.S. Pat. No. 3,767,108 discloses a similar tray construction for a single serving package wherein the web or gusset panels between the nominal side wall portions are folded and glued to an adjacent side wall portion to produce a leak proof container. The tray so formed is satisfactory, but it also ends up with three thicknesses of the tray material in the gusset area. Moreover, because of the manner in which the blank is scored, the tray has a cup-like or dish-like configuration. In addition, despite the fact that the flange panels overlap one another in the region of the gusset panels, there is no positive locking action between the overlapping panels. Accordingly, in order to overcome the problems of construction with the prior art and to achieve a more reliable and positive action during the tray forming operation, the present invention was developed.

SUMMARY OF INVENTION

The present invention relates to a tray-like food package of generally polygonal shape, and more particularly to a bake-in tray for dry foods. In addition, the present invention relates to the method and means for forming such a tray to produce a precisely shaped, durable and rigid construction. The tray is prepared from a single blank of paperboard or the like, and preferably ovenable paperboard that is able to withstand the temperatures encountered during a cooking process without charring. Prior to being formed, the tray blank is cut and scored in a die press operation to produce the desired tray shape and the attendant panels, flanges and tabs that are used to form the tray. After cutting and scoring, the blank is operated on with suitable tray forming equipment wherein the various panels and flaps are folded and glued together to produce the final tray construction.

In its preferred form, the tray comprises a substantially horizontal bottom wall, an inclined side wall having a surface formed from a plurality of independent panels that are foldably attached to the bottom wall, and a substantially horizontal peripheral flange that is formed from a plurality of overlapping independent panels that are foldably attached to the side walls panels. For this purpose, the bottom wall is applied with a plurality of connected, inner score lines which define the generally polygonal shape of the tray. These score lines also form the points of attachment for the individual side wall segments to the bottom wall. Each side wall segment includes an integral, triangularly shaped tab element foldably attached thereto along a score line. The latter score line is formed in the side wall segment, and extends from and is substantially perpendicular to one end of the inner score line connecting the side wall segment to the bottom wall. Meanwhile, the opposite side and end of each tab element is formed by cut lines so that the triangularly shaped tab elements remain connected to the side walls only along one edge. Thus while the side edges of each wall segment are formed by the cut lines which define the edges of the integral tab elements, the outer edges of the side wall segments are formed by a plurality of outer score lines that are generally parallel to, and are of about the same length as the inner score lines. The outer score lines are located slightly inwardly from the outside edge of the blank and define the points of attachment for the individual flange segments to the side wall segments. The flange segments are further formed by cut lines at each side thereof. These cut lines emanate from the intersection of the outer score line and the tab element score line of each side wall segment, and extend toward the outside edge of the blank at an angle that is preferably greater than ninety degrees as measured from the adjacent outer score line. This orientation of the cut lines in the flange in combination with the cut lines which form the outer free edges of each tab element provides each flange segment with extensions at each end which overlap the adjacent flange segments when the tray is formed. The flange extensions also serve as guides and as stops which prevent any unwanted excess overlap of the tab elements with their respective adjacent side wall segments when the tray is formed.

It is to be understood that the tab elements attached to each side wall segment serve the function of taking up the surplus blank material when the side walls are folded upwardly, and, for securing the side wall segments together when the tray is formed. Thus, the size, dimensions and shape of the tab elements may be varied depending upon the height of the side wall and the angle of inclination of the side wall with respect to the bottom wall. Meanwhile, because the excess blank material in the flange area is not removed, but formed substantially as described above, the flange extensions serve the dual purpose of preventing any overfolding between the side wall segments, and, when secured to their adjacent flange segments, produce a rigid and durable structure without the objectionable formation of multiple thicknesses of the blank material. Thus, while it is a primary object of the present invention to provide a new and improved bake-in paperboard tray, it is a further object to provide such a tray that is easier to manufacture and form than the prior art constructions of a similar type.

DETAILED DESCRIPTION

Figure 1:
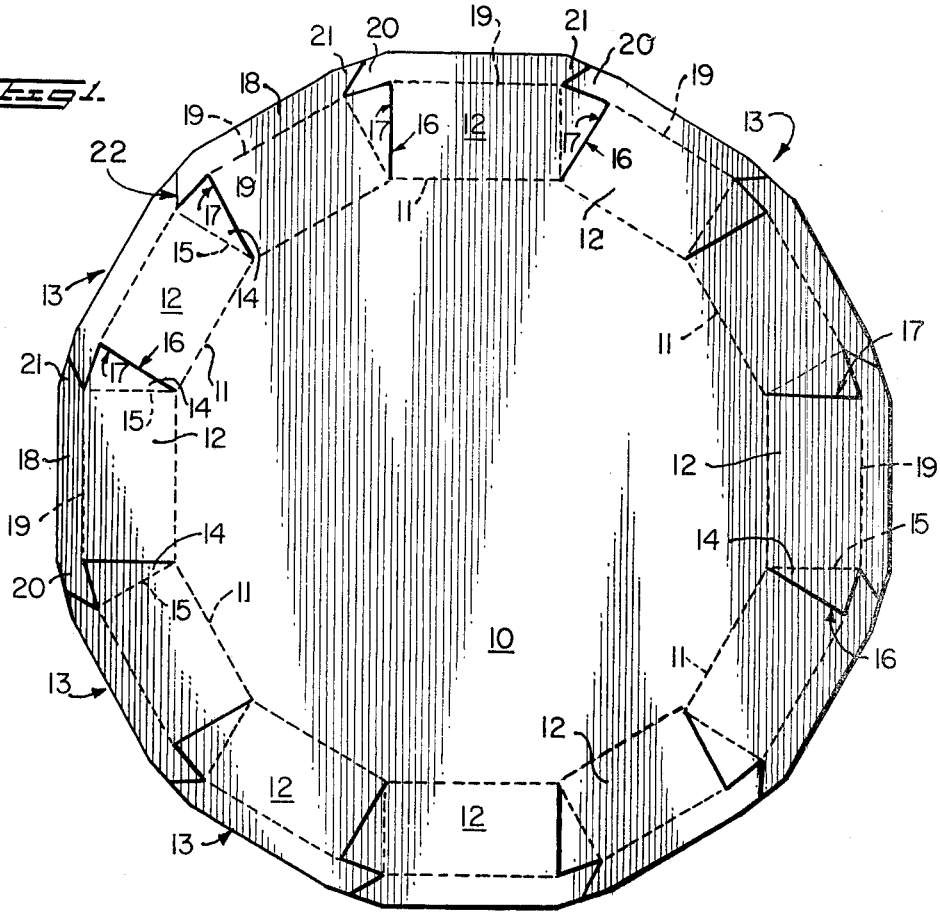
FIG. 1 is a plan view of a paperboard blank that is cut and scored to provide the tray of the present invention.

As shown more particularly in FIG. 1, the tray-like receptacle of the present invention is formed from a single, flat substantially circular blank of bendable material such as paperboard or the like. In its preferred form, the paperboard blank is constructed from ovenable paperboard, or paperboard that has a thermally stable coating on at least one side thereof which will enable the final tray to withstand the temperatures normally encountered during baking in a conventional oven. However, to enable the substantially circular paperboard blank to better form the desired tray construction, the blank is cut and scored to produce a substantially polygonal outline in the region where the scored inner fold lines 11 connect the individual side wall segments 12 to the bottom wall 10. The number of side wall segments 12, hence polygonal edges 13 of the blank are not material except that the more sidewalls provided, the easier the tray is to form. Nevertheless, each side wall panel 12 has at one of its side or lateral edges a triangular tab element 14 which is hinged thereto along a scored line 15 and which has an opposite free angularly disposed edge 16. The free edge 16 of the tab element 14 also corresponds to the free edge 17 of the next adjacent side wall panel 12. Meanwhile, each side wall panel 12 also has a corresponding peripheral flange panel segment 18 foldably attached to the outer end thereof along a fold line 19. The peripheral flange panels 18 are located in the outermost region of the blank and thus contain more blank material than the side wall panels 12. Thus, in order to take up the excess blank material when the tray is formed, the side wall panels 12 include the integrally attached tab elements 14 and the peripheral flange panels 18 each include extensions 20,21 at the ends thereof.

Figure 2:
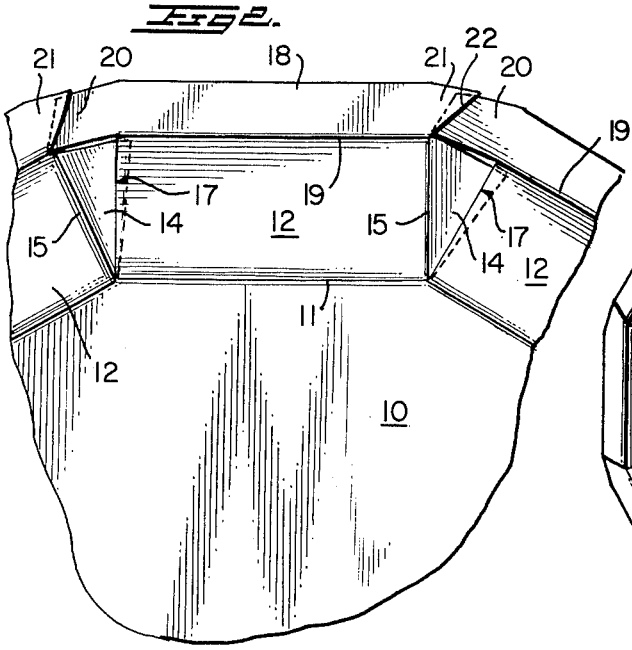
FIG. 2 is a fragmental plan view of the blank showing how the side wall segments and flange segments are overlapped with one another during the forming step; and, FIG. 3 is a plan view of the final tray.
Figure 3:
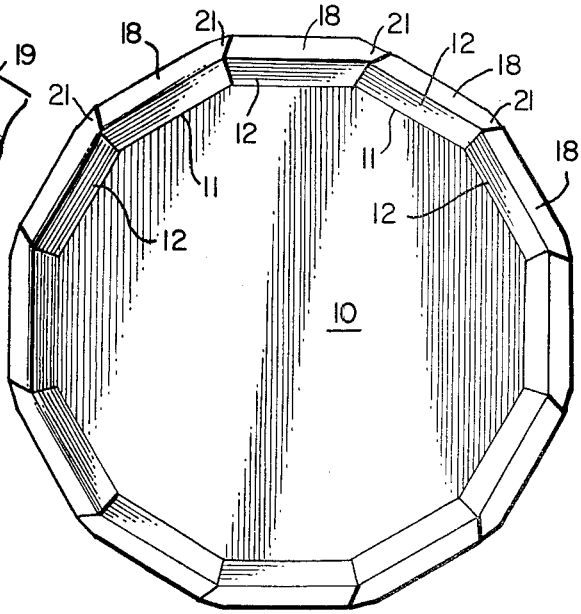

In the preferred form, the flange panel extension 20 is located at the end of the flange panel 18 adjacent to the free edge 17 of the next adjacent tab element 14. Meanwhile, the flange panel extension 21 is located at the end of the flange panel 18 adjacent to the tab element 14 of the attached side wall panel 12. As shown, the extensions 20,21 are not simply formed as two equally sized, equally shaped portions, but are formed by diagonal cut lines 22 that extend from the intersection of the scored lines 15 and 19 to the outer edge of the blank. The angulation of the cut lines 22 is not critical, but it should not be formed as an extension of the fold line 15, nor should it extend across the flange area toward a point on the outer edge of the blank that would correspond to an imaginary line extending from the free edge 17 of the tab element 14. In either of the latter cases, no overlap would be achieved by the flange panel extensions 20,21 when the tray-like receptacle was formed, in contrast to the case for the particular orientation disclosed wherein an overlap is achieved. Thus, the angulation of cut line 22 must be such as to produce two flange panel extensions 20,21 that interlock with, and overlap one another during the forming step. During the forming step, as shown in FIG. 2, the side walls 12 are folded upwardly along score lines 11 and the tab elements 14 at one lateral edge of each side wall 12 are directed behind the next adjacent side walls 12 where they are secured to the outer surfaces thereof. Meanwhile, because of the angulated orientation of the cut lines 22, the adjacent flange flap extensions 20,21 are directed respectively such that the extensions 21 project beneath and are secured to the outer surfaces of their adjacent flange panels 18, while the extensions 20 project over and are secured to the inner surfaces of their adjacent flange panels 18. In this manner a positive interengagement between the flange flap extensions 20,21 is produced and a proper orientation of the side walls is achieved to result in a substantially uniform receptacle.

Thus, while the present invention has been described and illustrated by the description set forth hereinabove, it is not intended to be strictly limited thereto, and other variations and modifications may be employed within the scope of the claims that follow.

I claim:

1. A polygonal shaped tray-like receptacle formed from a single blank of bendable material comprising, a bottom wall and an upwardly extending side wall foldably attached to said bottom wall and terminating along its upper edge in a peripherally extending flange, said side wall and peripheral flange each being formed from a plurality of discreet segments, the improvement wherein each side wall segment includes a tab element of generally triangular shape that is foldably connected along one side edge thereof to the side wall segment and which is secured to the outer surface of an adjacent side wall segment, and each peripheral flange segment includes extensions at each end thereof which are secured alternately to the upper and lower surfaces of the adjacent flange segments with the flange segment extension adjacent to said side wall tab element secured to the upper surface of its adjacent flange segment and the flange segment extension at the opposite end secured to the lower surface of its adjacent flange segment.

2. The receptacle of claim 1 wherein the flange segment extensions are formed by cut lines in the flange area so as to provide guides and stops which prevent excessive overlap of the tab elements with their adjacent side wall segments.

* * * * *